US009538845B1

(12) United States Patent
Chen

(10) Patent No.: US 9,538,845 B1
(45) Date of Patent: Jan. 10, 2017

(54) SYNCHRONOUS MECHANISM OF SLIDE RAIL

(71) Applicant: MARTAS PRECISION SLIDE CO., LTD., New Taipei (TW)

(72) Inventor: Wan-Lai Chen, New Taipei (TW)

(73) Assignee: Martas Precision Slide Co., Ltd., New Taipei (TW)

( * ) Notice: Subject to any disclaimer, the term of this patent is extended or adjusted under 35 U.S.C. 154(b) by 0 days.

(21) Appl. No.: 15/000,373

(22) Filed: Jan. 19, 2016

(51) Int. Cl.
*A47B 88/04* (2006.01)
*A47B 88/08* (2006.01)

(52) U.S. Cl.
CPC ..... *A47B 88/08* (2013.01); *A47B 2210/007* (2013.01); *A47B 2210/0081* (2013.01)

(58) Field of Classification Search
CPC . A47B 88/08; A47B 88/04; A47B 2210/0016; A47B 2210/0064; A47B 2210/007; A47B 2210/0081
See application file for complete search history.

(56) References Cited

U.S. PATENT DOCUMENTS

| | | | | |
|---|---|---|---|---|
| 5,551,775 | A * | 9/1996 | Parvin | A47B 88/10 312/334.11 |
| 7,520,577 | B2 * | 4/2009 | Chen | A47B 88/10 312/333 |
| 2006/0029304 | A1 * | 2/2006 | Chen | A47B 88/10 384/18 |
| 2007/0164644 | A1 * | 7/2007 | Hwang | A47B 88/08 312/333 |
| 2012/0201484 | A1 * | 8/2012 | Chen | A47B 88/10 384/21 |

* cited by examiner

*Primary Examiner* — Daniel Rohrhoff
(74) *Attorney, Agent, or Firm* — Rosenberg, Klein & Lee

(57) ABSTRACT

A synchronous mechanism of a slide rail includes a first hooked bracket, a second hooked bracket, an inner hook set and an outer hook set. The first hooked bracket and the second hooked bracket are installed on a middle rail, and the inner hook set is installed on an inner rail, and the outer hook set is installed on an outer rail. When the slide rail is pulled out or pushed in, the inner, middle, and outer rails are interacted, so that the inner rail, the middle rail and the outer rail can be moved synchronously when they are pushed in or pulled out, so as to improve the smoothness and stability of the operation and the practicality and service life of the product.

4 Claims, 12 Drawing Sheets

SYNCHRONOUS MECHANISM OF SLIDE RAIL

TECHNICAL FIELD

The technical field relates to the area of auxiliary slide equipments, and more particularly to a synchronous mechanism of a slide rail capable of improving the smoothness and stability while pulling out or pushing in the slide rail.

BACKGROUND

In general, furniture, office desks, cabinets, or industrial rackmount chasses include two parts, respectively: a movable part and a fixed part, and the movable part can be moved with respect to the fixed part for storage or use. Therefore, a conventional three-stage slide rail comprised of an outer rail, a middle rail and an inner rail is adopted to improve the smoothness of the movable components during use, wherein the outer rail is generally fixed to the fixed part, and the inner rail is fixed to the movable part, and the middle rail is coupled between the outer rail and the inner rail by a ball bearing type slide assisting element, so that the inner rail and the middle rail can be pushed or pulled reciprocally in the axial direction with respect to the outer rail in order to pull out or push in the movable part with respect to the fixed part, and such three-stage slide rail can be pulled or pushed to a relatively large extent to achieve the effects of reducing the occupying space significantly for storage, catching the attention of most related manufacturers, and providing a popular useful product.

However, the three-stage slide rail requires an additional linking mechanism in order to fully pull out the middle rail, maintain its fixed status, and pull out the inner rail synchronously in order to obtain the best smoothness and stability of the operation, and such linking mechanism is called "a synchronous mechanism of a slide rail". Since the middle rail is usually situated at an outermost position where the middle rail is pulled out when the slide rail is fully pulled out, and the fixed status of the middle rail is released while the inner rail is retracted and stored in order to receive the middle rail synchronously. Compared with the using status of a conventional movable part (such as a drawer), the slide rail can just provide a way of pulling out the inner rail and the middle rail synchronously to reduce the load stress produced when pulling out the middle rail to improve the service life of the slide rail only, but it still has the drawback of unable to wait for the inner rail to slide to the top of the middle rail into before restoring its original position synchronously. With such arrangement, a very large torque may be exerted onto the middle rail during the process of pushing in the middle rail, and may even damage the middle rail. Facts show that when the slide rail is damaged, the damage usually occurs at the joint between the middle rail and the inner rail. Therefore, it is a difficult problem for related manufacturers to resume the middle rail and the inner rail to their original positions synchronously.

In view of the aforementioned problem, the disclosure of this disclosure based on years of experience to conduct extensive researches and experiments, and finally developed a synchronous mechanism of a slide rail to obtain a very effective interactive relation by a simple mechanical method to improve the smoothness and stability of the slide rail, so that the slide rail produces become more practical and extensively used in various different products.

SUMMARY

In view of the problems of the prior art, it is a primary objective of this disclosure to provide a synchronous mechanism of a slide rail, and an inner hook set installed at an inner rail, a first hooked bracket and a second hooked bracket of a middle rail, and an outer hook set of an outer rail are used, so that the inner rail, the middle rail and the outer rail can be pushed in or pulled out sequentially and synchronously in a smooth manner when the slide rail is pulled out or pushed in, so as to improve the smoothness and stability of the slide rail.

To achieve the aforementioned objective, this disclosure provides a synchronous mechanism of a slide rail, and the slide rail comprises an inner rail, a middle rail and an outer rail, and the synchronous mechanism drives the inner rail, the middle rail and the outer rail to be sequentially pulled out or pushed in, and the direction of pulling out the rail is defined as a front side, and the synchronous mechanism comprises: a first hooked bracket, movably and pivotally coupled to a surface of the middle rail, and having a first elastic portion and a first stop portion disposed on two opposite sides of the first hooked bracket respectively, and a first lever installed to a side of the first stop portion; a second hooked bracket, movably and pivotally coupled to a surface of the middle rail, and disposed with a spacing apart from a side of the first hooked bracket, and having a second elastic portion and a second stop portion disposed on two opposite sides of the second hooked bracket respectively, and a second lever installed to a side of the second stop portion; an inner hook set, installed in a middle section of the inner rail, and disposed on a surface configured to be corresponsive to the first hooked bracket and the second hooked bracket, and the inner hook set moving synchronously with the inner rail and interacting with the first hooked bracket in a moving process; and an outer hook set, installed at a front section of the outer rail, and disposed on a surface configured to be corresponsive to the first hooked bracket and the second hooked bracket, and the outer hook set moving synchronously with the outer rail, and interacting with the first hooked bracket and the second hooked bracket in a moving process; such that the inner rail and the middle rail are moved synchronously when the slide rail is pulled out, since the inner hook set is limited by the first hooked bracket, and the middle rail is pulled out with respect to the outer rail until the outer hook set is interacted with the first hooked bracket and the second hooked bracket, and the limit of the first hooked bracket and the second hooked bracket with the inner hook set is released, so that the inner rail can be pulled out with respect to the middle rail; on the other hand, when the slide rail is pushed in, the outer rail and the middle rail remain still since the outer hook set is limited by the first hooked bracket and the second hooked bracket, and the inner rail is pushed in with respect to the middle rail until the inner hook set is interacted with the first hooked bracket and the second hooked bracket, and the limit of the first hooked bracket and the second hooked bracket with the outer hook set is released, before the middle rail can be pushed in with respect to the outer rail.

In a preferred embodiment, the first stop portion and the second stop portion are situated at positions of different height and have a predetermined height difference after the first hooked bracket and the second hooked bracket are fixed to the middle rail, and the inner hook set is formed by a first inner hook and a second inner hook disposed apart from each other, and the first inner hook and the second inner hook are configured to be corresponsive to the first stop portion and arranged into a triangular shape, and the first inner hook and the second inner hook are disposed at positions of the same height; the outer hook set is formed by a first outer hook and a second outer hook installed with a spacing apart from each other, and the first outer hook and the second outer hook are configured to be corresponsive to the first stop portion and the second stop portion and arranged into a triangular shape, and the first outer hook and the second outer hook are corresponsive to the predetermined height difference of the first stop portion and the second stop portion and disposed at positions of different heights respectively.

In addition, the middle rail has a first fixing slot and a first guide slot configured to be corresponsive to the first hooked bracket, and a second fixing slot and a second guide slot configured to be corresponsive to the second hooked bracket, and the first elastic portion is disposed in the first fixing slot, and the first stop portion and the first lever are passed out from the first guide slot and situated in a moving status, and the second elastic portion is disposed in the second fixing slot, and the second stop portion and the second lever are passed out from the second guide slot and situated in a moving status. Wherein, the first hooked bracket and the second hooked bracket are formed by punching and bending, so that the first stop portion and the first lever are bent towards the same side of the first hooked bracket, and the second stop portion and the second lever are bent towards the same side of the second hooked bracket to facilitate the interaction of the inner hook set and the outer hook set, so as to improve the smoothness and stability of the operation of the slide rail.

DESCRIPTION OF THE PREFERRED EMBODIMENTS

The above and other objects, features and advantages of this disclosure will become apparent from the following detailed description taken with the accompanying drawings.

Figure 1:
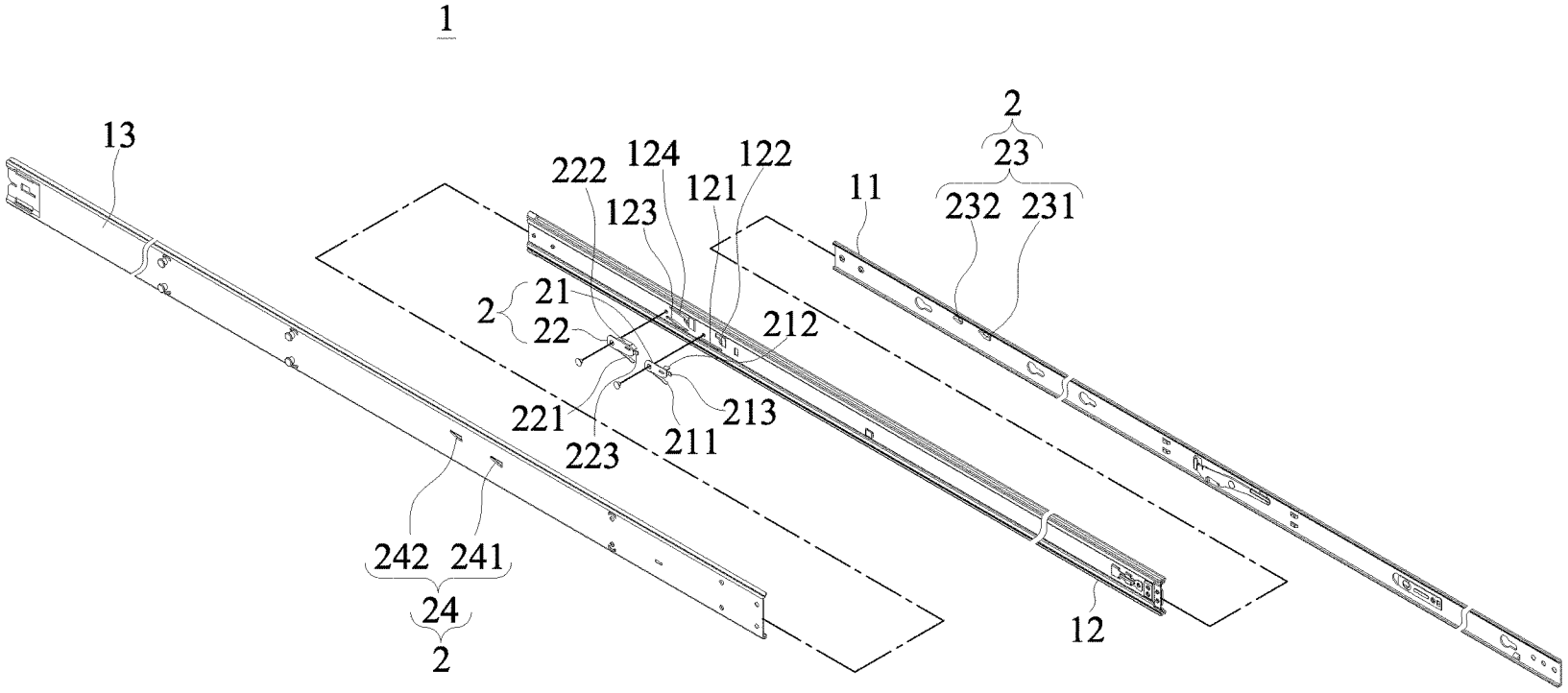
FIG. 1 is a schematic view of the structure of a preferred embodiment of this disclosure viewing from a first viewing angle.
Figure 2:
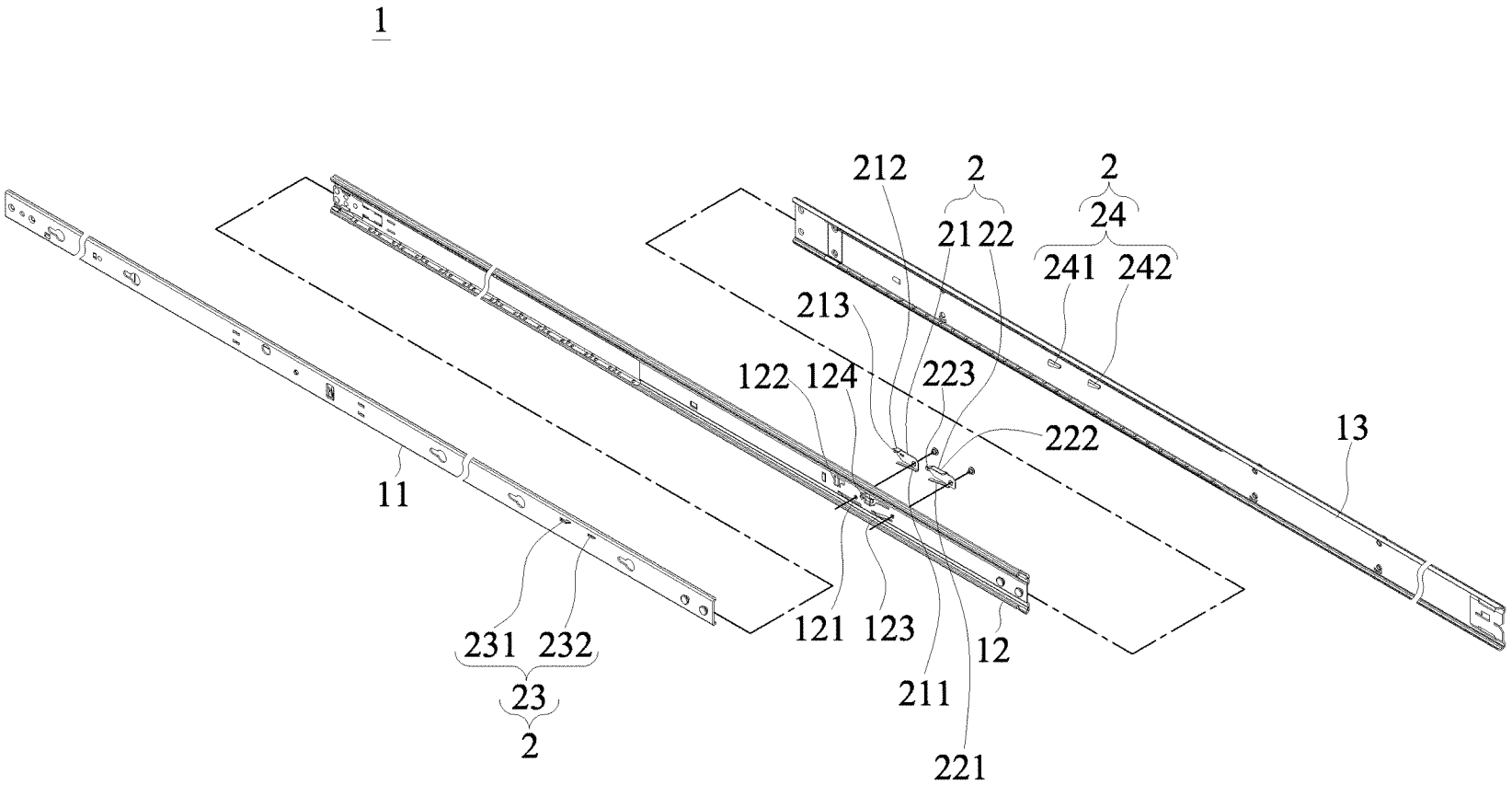
FIG. 2 is a schematic view of the structure of a preferred embodiment of this disclosure viewing from a second viewing angle.
Figure 3A:
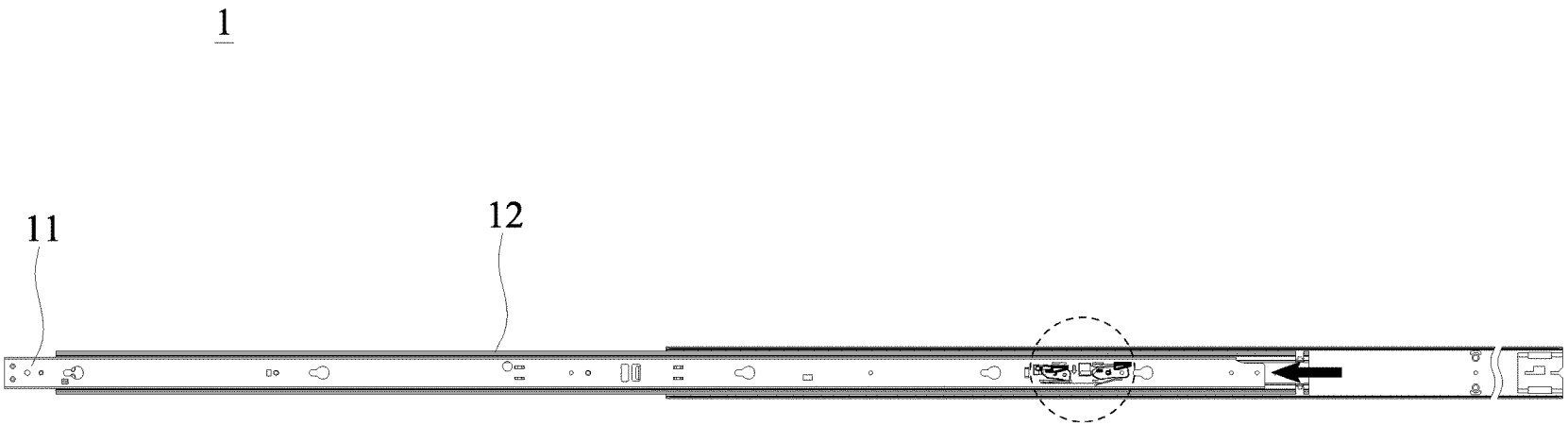
FIG. 3A is a first schematic view of a preferred embodiment of this disclosure at a pulled-out status.
Figure 3B:
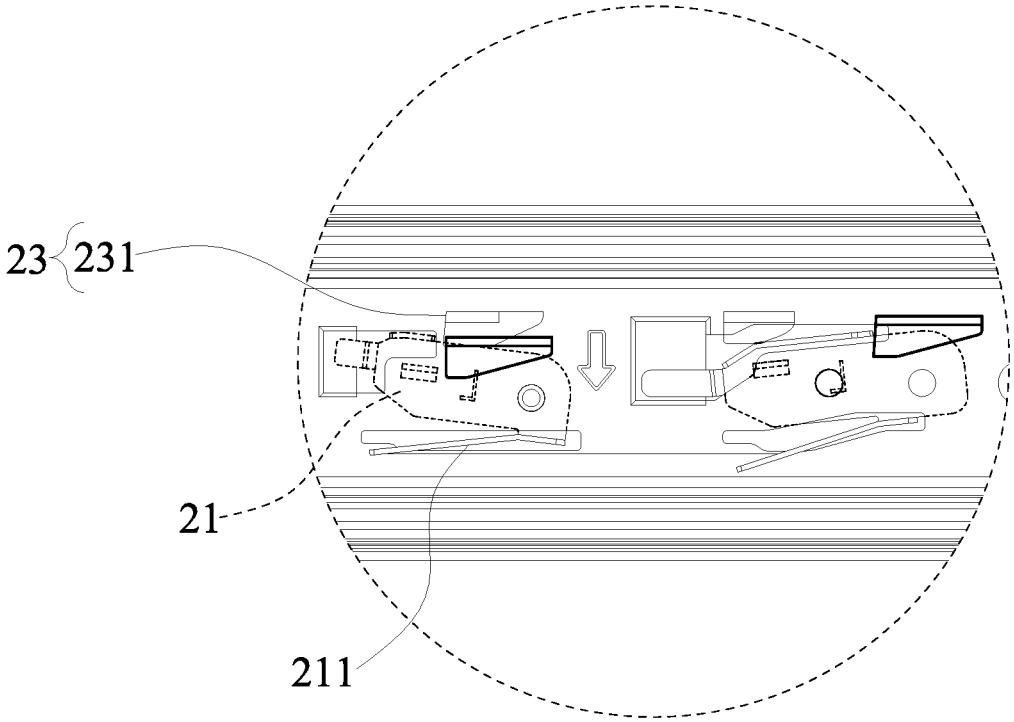
FIG. 3B is a detailed first schematic view of a preferred embodiment of this disclosure at a pulled-out status.
Figure 4A:
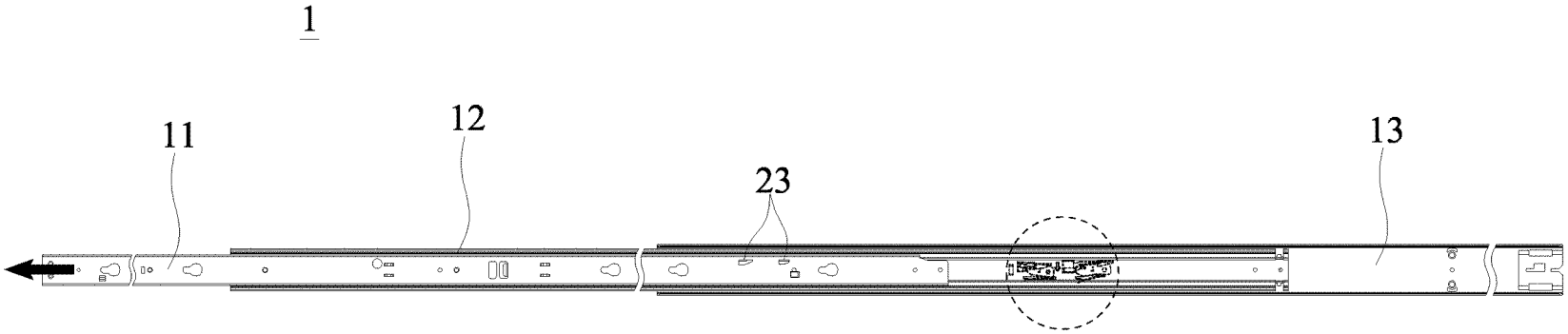
FIG. 4A is a second schematic view of a preferred embodiment of this disclosure at a pulled-out status.
Figure 4B:
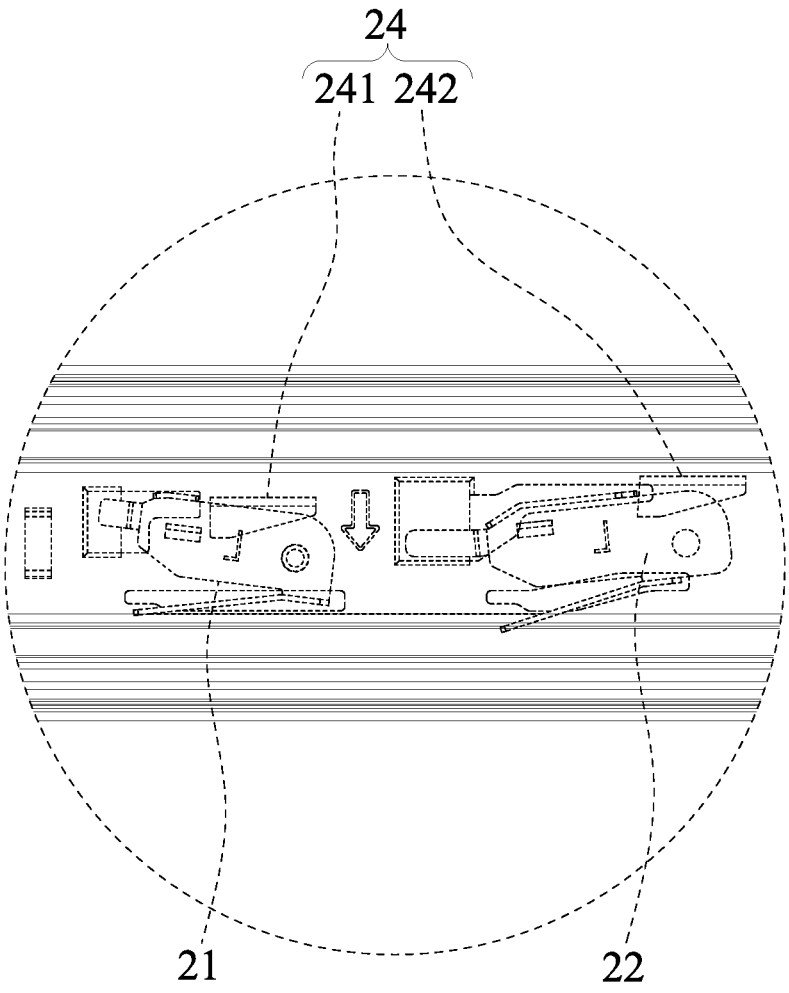
FIG. 4B is a detailed second schematic view of a preferred embodiment of this disclosure at a pulled-out status.
Figure 5:
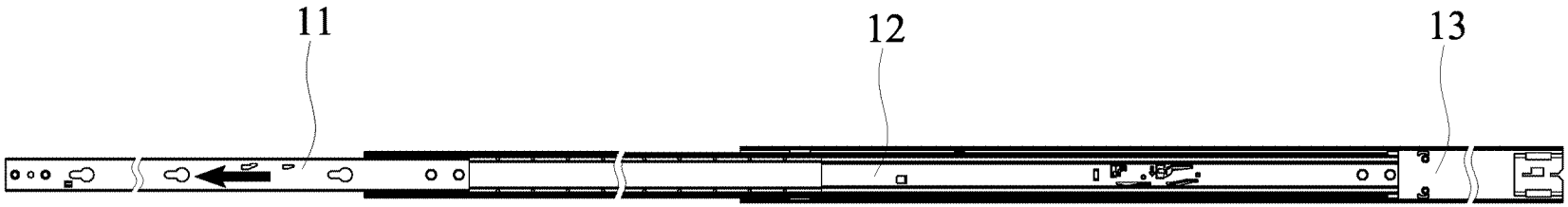
FIG. 5 is a third schematic view of a preferred embodiment of this disclosure at a pulled-out status.
Figure 6A:
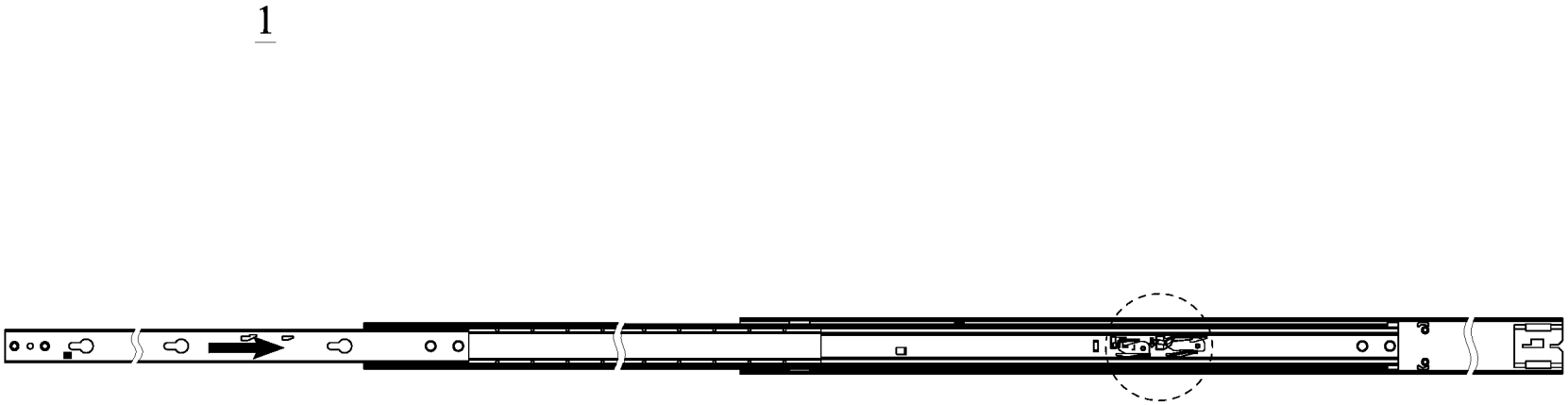
FIG. 6A is a first schematic view of a preferred embodiment of this disclosure at a pushed-in status.
Figure 6B:
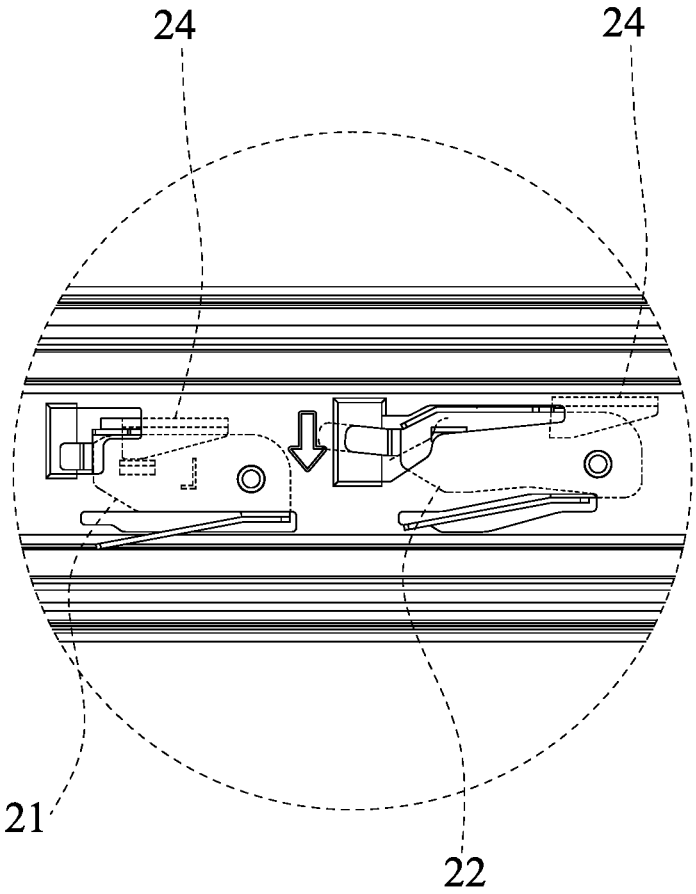
FIG. 6B is a detailed first schematic view of a preferred embodiment of this disclosure at a pushed-in status.
Figure 7A:
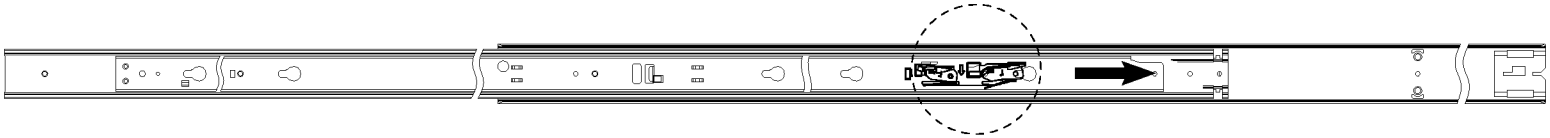
FIG. 7A is a second schematic view of a preferred embodiment of this disclosure at a pushed-in status.
Figure 7B:
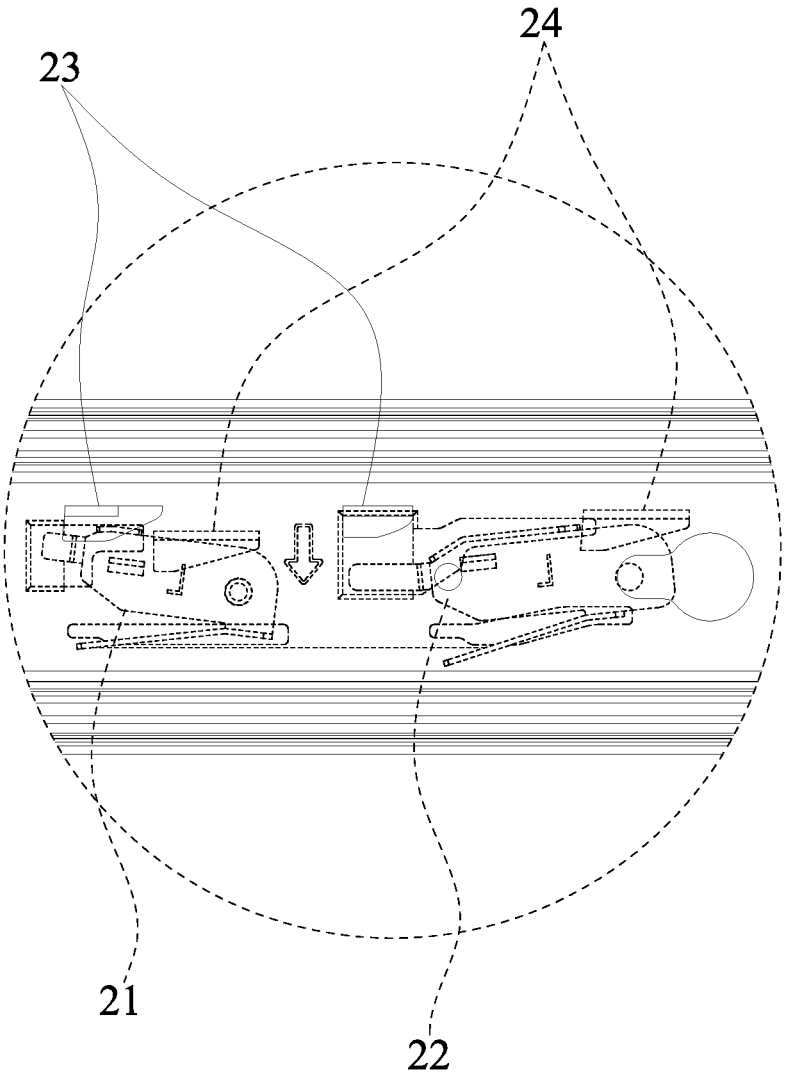
FIG. 7B is a detailed second schematic view of a preferred embodiment of this disclosure at a pushed-in status.
Figure 8:
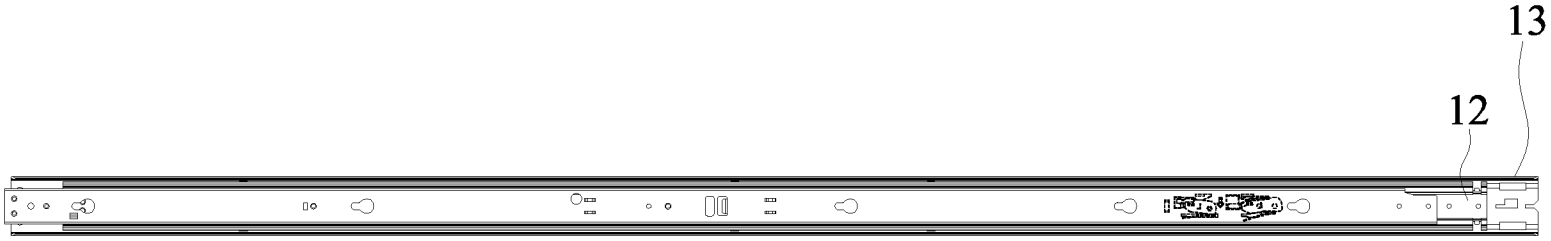
FIG. 8 is a third schematic view of a preferred embodiment of this disclosure at a pushed-in status.

With reference to FIGS. 1 and 2 for a schematic view and a perspective view of the structure of a preferred embodiment of this disclosure respectively and FIGS. 3A to 8 for schematic views of various different operating statuses of a synchronous mechanism 2 of a slide rail 1 in accordance with this disclosure respectively, the slide rail 1 includes an inner rail 11, a middle rail 12 and an outer rail 13, and the synchronous mechanism 2 drives the inner rail 11, the middle rail 12 and the outer rail 13 to be sequentially pulled out and pushed in, and the direction for pulling out the rail is defined as a front side, and the synchronous mechanism 2 comprises a first hooked bracket 21, a second hooked bracket 22, an inner hook set 23, and an outer hook set 24.

Wherein, the first hooked bracket 21 is made of a metal sheet, formed by punching and bending, and movably and pivotally coupled to a surface of the middle rail 12, and the middle rail 12 has a first fixing slot 121 and a first guide slot 122 formed thereon and configured to be corresponsive to the first hooked bracket 21, and the first hooked bracket 21 has a first elastic portion 211 and a first stop portion 212 disposed on two opposite sides of the first hooked bracket 21 respectively and a first lever 213 installed on a side of the first stop portion 212. After assembling, the first elastic portion 211 is disposed in the first fixing slot 121, and the first stop portion 212 and the first lever 213 are passed out from the first guide slot 122 and situated in a moving status.

The second hooked bracket 22 is also made of a metal sheet, formed by punching and bending, movably and pivotally coupled to a surface of the middle rail 12 and disposed at a position with a spacing apart from a side of the first hooked bracket 21, and the middle rail 12 has a second fixing slot 123 and a second guide slot 124 formed thereon and configured to be corresponsive to the second hooked bracket 22, and the second hooked bracket 22 has a second elastic portion 221 and a second stop portion 222 disposed on two opposite sides of the second hooked bracket 22 respectively and a second lever 223 installed on a side of the second stop portion 222. During assembling, the second elastic portion 221 is disposed in the second fixing slot 123, and the second stop portion 222 and the second lever 223 are passed out from the second guide slot 124 and situated in a moving status. It is noteworthy that after the first hooked bracket 21 and the second hooked bracket 22 are fixed to the middle rail 12, the first stop portion 212 and the second stop portion 222 are situated at position of different heights and have a predetermined height difference.

The inner hook set 23 is formed by a first inner hook 231 and a second inner hook 232 installed with a spacing apart from each other, and the first inner hook 231 and the second inner hook 232 are configured to be corresponsive to the first stop portion and arranged into a triangular shape, and the first inner hook 231 and the second inner hook 232 are situated at positions of the same height and installed in a middle section of the inner rail 11 and disposed on a surface corresponsive to the first hooked bracket 21 and the second hooked bracket 22, and the inner hook set 23 is moved synchronously with the inner rail 11 and interacted with the first hooked bracket 21 during a moving process. For example, the inner hook set 23 is latched or directly passed through the first hooked bracket 21.

The outer hook set 24 is formed by a first outer hook 241 and a second outer hook 242 installed with a spacing apart from each other, and the first outer hook 241 and the second outer hook 242 are configured to be corresponsive to the first stop portion 212 and the second stop portion 222 respectively and arranged into a triangular shape, and the first outer hook 241 and the second outer hook 242 have the predetermined height difference with respect to the first stop portion 212 and the second stop portion 222 and are situated at positions of different heights respectively, and the outer hook set 24 is installed at a front section of the outer rail 13 and disposed on a surface corresponsive to the first hooked bracket 21 and the second hooked bracket 22, and the outer hook set 24 is moved synchronously with the outer rail and interacted with the first hooked bracket 21 and the second hooked bracket 22 in a moving process.

With reference to FIGS. 3A to 5 for various different statuses when the slide rail is pulled out in accordance with a preferred embodiment of this disclosure respectively, when the slide rail 1 is pulled out, the resilience of first hooked bracket 21 (or the first elastic portion 211) drives the first stop portion 212 and the first lever 213 to move upward, so that in the moving process, the inner hook set 23 (particularly the first inner hook 231) at the top of the inner rail 11 and the first hooked bracket 21 (particularly the first stop portion 212) are latched with each other to achieve the limiting effect, so that the inner rail 11 and the middle rail 12 will be moved synchronously, and the inner rail 11 and the middle rail 12 are stacked with each other to improve the strength of the slide rail, and the middle rail 12 together with the inner rail 11 will be pulled out with respect to the outer rail 13 until the outer hook set 24 (particularly the first outer hook 241 and the second outer hook 242) is interacted with the first hooked bracket 21 and the second hooked bracket 22, and the first outer hook 241 will hit a bevel of the first stop portion 212 of the first hooked bracket 21, and the second outer hook 241 will hit a bevel of the second stop portion 222 of the second hooked bracket 22, such that the first hooked bracket 21 and the second hooked bracket 22 will be moved downward and latched to achieve the effect of releasing the limitation of the first hooked bracket 21 and the second hooked bracket 22 from the inner hook set 23. Now, the middle rail 12 is fully pulled out with respect to the outer rail 13. Finally, the inner rail 11 is released from the limitation and performs the last section of the pulled-out stroke with respect to the middle rail 12.

With reference to FIGS. 6A to 8 for various different statuses of the slide rail in accordance with a preferred embodiment of this disclosure when the slide rail is pushed in, the outer hook set 24 is latched by the first hooked bracket 21 and the second hooked bracket 22 to provide the limiting effect when the slide rail is pulled out, so that the outer rail 13 and the middle rail 12 remain still, and the inner rail 11 is situated in a moving status with respect to the middle rail 12, and the inner rail 11 can be pushed in with respect to the middle rail 12. After the inner rail 11 is completely received by the middle rail 12, the inner hook set 23 is interacted with the first hooked bracket 21 and the second hooked bracket 22, and the limitation of the first hooked bracket 21 and the second hooked bracket 22 is released from the outer hook set 24. Finally, after the limitation of the middle rail 12 is released, the middle rail 12 can be pushed into the outer rail 13 to complete the whole push-in process.

In summation of the description above, this disclosure is capable of controlling the sequence when the rails are pulled out or pushed in to prevent wrong operations or affect the service life of the slide rail and also improve the smoothness of the operation. In addition, this disclosure achieves the effect of lowering the manufacturing cost and the assembling cost without adding additional components to the structure. Obviously, this disclosure is an important and useful design for related manufacturers.

What is claimed is:

1. A synchronous mechanism of a slide rail, and the slide rail including an inner rail, a middle rail and an outer rail, and the synchronous mechanism driving the inner rail, the middle rail and the outer rail to be sequentially pulled out or pushed in, and a direction of pulling out the rail being defined as a front side, and the synchronous mechanism comprising:

a first hooked bracket, movably and pivotally coupled to a surface of the middle rail, and having a first elastic portion and a first stop portion disposed on two opposite sides of the first hooked bracket respectively, and a first lever installed to a side of the first stop portion;

a second hooked bracket, movably and pivotally coupled to a surface of the middle rail, and disposed with a spacing apart from a side of the first hooked bracket, and having a second elastic portion and a second stop portion disposed on two opposite sides of the second hooked bracket respectively, and a second lever installed to a side of the second stop portion;

an inner hook set, installed in a middle section of the inner rail, and disposed on a surface configured to be corresponsive to the first hooked bracket and the second hooked bracket, and the inner hook set moving synchronously with the inner rail and interacting with the first hooked bracket in a moving process; and an outer hook set, installed at a front section of the outer rail, and disposed on a surface configured to be corresponsive to the first hooked bracket and the second hooked bracket, and the outer hook set moving synchronously with the outer rail, and interacting with the first hooked bracket and the second hooked bracket in a moving process; such that the inner rail and the middle rail are moved synchronously when the slide rail is pulled out, since the inner hook set is limited by the first hooked bracket, and the middle rail is pulled out with respect to the outer rail until the outer hook set is interacted with the first hooked bracket and the second hooked bracket, and the limit of the first hooked bracket and the second hooked bracket with the inner hook set is released, so that the inner rail can be pulled out with respect to the middle rail; on the other hand, when the slide rail is pushed in, the outer rail and the middle rail remain still since the outer hook set is limited by the first hooked bracket and the second hooked bracket, and the inner rail is pushed in with respect to the middle rail until the inner hook set is interacted with the first hooked bracket and the second hooked bracket, and the limit of the first hooked bracket and the second hooked bracket with the outer hook set is released, before the middle rail can be pushed in with respect to the outer rail.

2. The synchronous mechanism of a slide rail according to claim 1, wherein the first stop portion and the second stop portion are situated at positions of different height and have a predetermined height difference after the first hooked bracket and the second hooked bracket are fixed to the middle rail, and the inner hook set is formed by a first inner hook and a second inner hook disposed apart from each other, and the first inner hook and the second inner hook are configured to be corresponsive to the first stop portion and arranged into a triangular shape, and the first inner hook and the second inner hook are disposed at positions of the same height; the outer hook set is formed by a first outer hook and a second outer hook installed with a spacing apart from each other, and the first outer hook and the second outer hook are configured to be corresponsive to the first stop portion and the second stop portion and arranged into a triangular shape, and the first outer hook and the second outer hook are corresponsive to the predetermined height difference of the first stop portion and the second stop portion and disposed at positions of different heights respectively.

3. The synchronous mechanism of a slide rail according to claim 2, wherein the middle rail has a first fixing slot and a first guide slot configured to be corresponsive to the first hooked bracket, and a second fixing slot and a second guide slot configured to be corresponsive to the second hooked bracket, and the first elastic portion is disposed in the first fixing slot, and the first stop portion and the first lever are passed out from the first guide slot and situated in a moving status, and the second elastic portion is disposed in the second fixing slot, and the second stop portion and the second lever are passed out from the second guide slot and situated in a moving status.

4. The synchronous mechanism of a slide rail according to claim 1, wherein the first hooked bracket and the second hooked bracket are formed by punching and bending.

* * * * *